US006130029A

United States Patent [19]

LeBlanc, Jr.

[11] Patent Number: 6,130,029

[45] Date of Patent: Oct. 10, 2000

[54] STABILIZED PHENYLENEDIAMINE COLOR DEVELOPER COMPOSITIONS

[75] Inventor: Charles Hubert LeBlanc, Jr., Kingsport, Tenn.

[73] Assignee: Eastman Chemical Company, Kingsport, Tenn.

[21] Appl. No.: 09/332,648

[22] Filed: Jun. 14, 1999

[51] Int. Cl.[7] ..... G03C 7/413

[52] U.S. Cl. ..... 430/467; 430/465

[58] Field of Search ..... 430/465, 467

[56] References Cited

U.S. PATENT DOCUMENTS 4,414,307 11/1983 Kapecki et al. ..... 430/465
4,923,786 5/1990 Kuhnert et al. ..... 430/465
5,336,588 8/1994 Ueda ..... 430/465

OTHER PUBLICATIONS

Kirk–Othmer, Encyclopedia of Chemical Technology, vol. 6, 965–1002, 4$^{th}$ Edition (1993).

*Primary Examiner*—Hoa Van Le
*Attorney, Agent, or Firm*—Michael J. Blake; Harry J. Gwinnell

[57] ABSTRACT

Disclosed is a method for the stabilization of dry N,N-dialkyl-p-phenylenediamine color developers and to the stabilized compositions thus obtained wherein the color developer which is susceptible to oxidative discoloration is intimately mixed with a stabilizing amount of an alkali metal metabisulfite, bisulfite or sulfite The method is particularly useful for the stabilization of salts of N-ethyl-N-(2-hydroxyethyl)4-amino-3-methylaniline.

5 Claims, No Drawings

STABILIZED PHENYLENEDIAMINE COLOR DEVELOPER COMPOSITIONS

INTRODUCTION

This invention pertains to a method for the stabilization of p-phenylenediamine color developers and to the stabilized compositions thus obtained. More specifically, this invention pertains to a method for the stabilization of dry, solid N,N-dialkyl-p-phenylenediamine color developers by intimately mixing with such developers an alkali metal bisulfite or sulfite. This invention also pertains to the substantially dry stabilized compositions provided by the method.

Developer solutions are used in the development of exposed photographic films to develop latent images contained on film which has been exposed to light. One of the components of the development solution for color photography is an N,N-dialkyl-p-phenylenediamine color developer. Another component typically present in developer solutions is a sulfite such as sodium sulfite. The sulfite functions as a preservative and scavenger of excess oxidized developer in developer solutions that otherwise would undergo a number of self-condensation reactions resulting in stain. See, for example the discussion of Color Photography in Kirk-Othmer, *Encyclopedia of Chemical Technology*, Vol. 6, 965, $4^{th}$ Edition (1993).

It recently has been observed that certain of the N,N-dialkyl-p-phenylenediamine color developers in a dry or substantially anhydrous form become discolored upon prolonged storage, especially at higher temperatures experienced in tropical regions. This discoloration, presumably due to oxidation, is manifested by the solid N,N-dialkyl-p-phenylenediamine compounds having a tan or gray, rather than normal white, appearance.

BRIEF SUMMARY OF THE INVENTION

It has been discovered that discoloration of solid N,N-dialkyl-p-phenylenediamine compounds can be substantially minimized by the inclusion therein of an alkali metal metabisulfite, bisulfate, or sulfite. The present invention, therefore, provides a more stable, substantially anhydrous composition comprising N,N-dialkyl-p-phenylenediamine color developer which is subject to oxidative discoloration in a finely divided form, e.g., a powder or granulation, and a stabilizing amount of an alkali metal metabisulfite, bisulfite or sulfite. Another embodiment of the invention involves a process for preparing a stabilized, substantially anhydrous composition comprising an N,N-dialkyl-p-phenylenediamine color developer which is subject to oxidative discoloration in a finely divided form which comprises the steps of (1) drying a water-wet N,N-dialkyl-p-phenylenediamine color developer in a chemical dryer, (2) adding a stabilizing amount of an alkali metal metabisulfite or sulfite to the dried N,N ialkyl-p-phenylenediamine color developer in the dryer to intimately mix the alkali metal metabisulfite, bisulfite or sulfite and N,N-dialkyl-p-phenylenediamine color developer and (3) removing from the dryer a substantially anhydrous composition comprising N,N-dialkyl-p-phenylenediamine color developer which exhibits improved stability to oxidative discoloration.

DETAILED DESCRIPTION

The alkali metal metabisulfite, bisulfite or sulfite used in the present invention preferably is potassium or, especially, sodium metabisulfite or sulfite. The stabilizing amount of metabisulfite or sulfite used normally will be at least 0.05 weight percent and will not exceed 1.0 weight percent based on the total weight of the stabilized composition. The concentration of the bisulfite salt in the color stabilized compositions of the present invention preferably is in the range of about 0.1 to 0.25 weight percent.

The N,N-dialkyl-p-phenylenediamine color developers which may be stabilized in accordance with the invention are known compounds used in color photography. The alkyl groups of the N,N-dialkyl moiety of the color developers may each contain up to about 8 carbon atoms, preferably up to about 4 carbon atoms, and may be unsubstituted or substituted. Examples of such substituents include alkylsulfonamido and hydroxyl. The p-phenylene moiety of the color developers may be unsubstituted or,preferably, substituted, for example, with an alkyl group, e.g., methyl. The N,N-dialkyl-p-phenylenediamine color developers preferably are selected from N,N-dialkyl-4-amino-3-methylanilines wherein the alkyl groups are selected from ethyl, 2-hydroxyethyl and 2-methanesulfonamidoethyl. As is known to those skilled in the art, the N,N-dialkyl-p-phenylenediamine color developers used in the present invention and in photographic developer solutions exist as acid addition salts, e.g., a hydrohalide such as a hydrochloride, sulfate or bisulfate. N,N-diethyl-4-amino-3-methylaniline hydrochloride (CD-2 CAS No. 002051-79-8), N-(2-methanesulfonamidoethyl)-N-ethyl-4-amino-3-methylaniline sulfate (CD-3 CAS No. 025646-71-3) and N-ethyl-N-(2-hydroxyethyl)-4-amino-3-methylaniline (CD4 CAS No. 025646-77-9) are specific examples of the color developers which may be stabilized in accordance with the present invention.

The stabilized compositions of the invention are dry or substantially anhydrous which is meant that the compositions are essentially free of water, i.e., the compositions contain less than about 0.6 weight percent volatile matter.

In the process of my invention, a water-wet N,N-dialkyl-p-phenylenediamine color developer is fed or placed in a chemical dryer and dried, e.g., at a temperature of about 70 to 75° C. and under reduced pressure, e.g., at a pressure less than about 10 Torr, and then a stabilizing amount of an alkali metal metabisulfite, bisulfite or sulfite is added to the dried color developer during the operation of the dryer to obtain a composition stabilized against oxidative discoloration and comprising the color developer in a finely divided form, e.g., a powder or granulation, having intimately dispersed therein an effective amount of the stabilizer.

To illustrate the effect of the present invention, a production batch of CD-4 was dried in a commercial dryer at approximately 75° C. under reduced pressure. When the color developer was dry, sodium metabisulfite was added to the drier in an amount which gave a concentration of 0.25 weight percent, based on the total weight of the CD-4 and sodium metabisulfite. The dry materials were mixed in the dryer to produce an intimate mixture of the color developer and stabilizer. The mixture was packaged in 22.36 Kg (50 pound) quantities in plastic bags which were sealed and placed in fiberboard drums which also were sealed. The packaged material was subjected to an accelerated degradation test for discoloration by placing the packaged material in an oven maintained at 95% relative humidity and 100 to 105° C. for three months. An identical package of CD-4 which contained no sodium metabisulfite (control material) also was subjected to the accelerated degradation test.

Stabilized and unstabilized CD-4 samples were evaluated for oxidative degradation by determining the absorptivity (color) at 540 nanometers (nm) using a Perkin-Elmer Lambda 2 (or equivalent) spectrophotometer. The CD-4 test sample was dissolved and diluted into 1.0 N aqueous sulfuric acid. Absorbance for the solution was recorded at 540 nm in a 10 cm cell and then net absorbance was calculated. The terms and symbols for Molecular Spectroscopy are defined in ASTM E131.

The stabilized and unstabilized material had an absorptivity of 0.17 to 0.20 mug-cm at 540 nm prior to being subjected to the above-described accelerated degradation test. At the end of the three-month the accelerated degradation test, the absorptivity for the stabilized CD-4 was 0.69 mug-cm whereas the absorptivity for the unstabilized CD-4 was 1.63.

The invention has been described in detail with particular reference to preferred embodiments thereof, but it will be understood that variations and modifications can be effected within the spirit and scope of the invention.

I claim:

1. A stabilized, substantially anhydrous composition comprising an N,N-dialkyl-p-phenylenediamine color developer selected from salts of N,N-diethyl-4-amino-3-methylaniline, N-(2-methanesulfonamidoethyl)-N-ethyl-4-amino-3-methylaniline and N-ethyl-N-(2-hydroxyethyl)-4-amino-3-methylaniline which is subject to oxidative discoloration in a finely divided form and about 0.05 to 1.0 weight percent of an alkali metal metabisulfite, bisulfite or sulfite, based on the total weight of the color developer and the alkali metal metabisulfite, bisulfite or sulfite.

2. A stabilized composition according to claim 1 wherein the alkali metal metabisulfite, bisulfite or sulfite is sodium metabisulfite, bisulfite or sulfite which is present in a concentration of about 0.1 to 0.25 weight percent based on the weight of the composition.

3. A stabilized, substantially anhydrous composition comprising a salt of N-ethyl-N-(2-hydroxyethyl)-4-amino-3-methylaniline in a finely divided form and sodium metabisulfite which is present in a concentration of about 0.1 to 0.25 weight percent based on the weight of the composition.

4. A process for preparing a stabilized, substantially anhydrous composition comprising an N,N-dialkyl-p-phenylenediamine color developer which is subject to oxidative discoloration in a finely divided form which comprises the steps of (1) drying a water-wet N,N-dialkyl-p-phenylenediamine color developer selected from salts of N,N-diethyl-4-amino-3-methylaniline, N-(2-methanesulfonamidoethyl)-N-ethyl-4-amino-3-methylaniline and N-ethyl-N-(2-hydroxyethyl)-4-amino-3-methylaniline in a chemical dryer, (2) adding an alkali metal metabisulfite, bisulfite or sulfite to the dried N,N-dialkyl-p-phenylenediamine color developer in the dryer to intimately mix the alkali metal metabisulfite, bisulfite or sulfite and N,N-dialkyl-p-phenylenediamine color developer and (3) removing from the dryer a substantially anhydrous composition comprising the N,N-dialkyl-p-phenylenediamine color developer which exhibits improved stability to oxidative discoloration wherein the alkali metal metabisulfite, bisulfite or sulfite is added in an amount which results in the substantially anhydrous composition comprising N,N-dialkyl-p-phenylenediamine color developer containing about 0.05 to 1.0 weight percent of the alkali metal metabisulfite, bisulfite or sulfite based on the total weight of the color developer and the alkali metal metabisulfite, bisulfite or sulfite.

5. Process according to claim 4 wherein the water-wet N,N-dialkyl-p-phenylenediamine color developer is dried at a temperature in the range of about 70 to 75° C. under reduced pressure and the alkali metal metabisulfite is sodium metabisulfite added in an amount which results in the substantially anhydrous composition comprising N,N-dialkyl-p-phenylenediamine color developer containing about 0.1 to 0.25 weight percent sodium metabisulfite based on the weight of the composition.

* * * * *